US005326486A

United States Patent [19]

Mizui et al.

[11] Patent Number: 5,326,486

[45] Date of Patent: Jul. 5, 1994

[54] LUBRICATING OIL COMPOSITION

[75] Inventors: Kinya Mizui; Kazuyuki Watanabe; Hidenori Kaya, all of Ichihara; Takashi Hayashi, Waki; Kenji Shimamoto, Waki; Masahide Tanaka, Waki; Kazunori Takahata, Waki, all of Japan

[73] Assignee: Mitsui Petrochemical Industries, Ltd., Tokyo, Japan

[21] Appl. No.: 950,838

[22] Filed: Sep. 25, 1992

[30] Foreign Application Priority Data

Sep. 27, 1991 [JP] Japan ..... 3-249198
Jun. 15, 1992 [JP] Japan ..... 4-154755

[51] Int. Cl.[5] ..... C10M 105/48

[52] U.S. Cl. ..... 252/46.006; 252/52 R; 252/49.008; 252/56 R; 252/68

[58] Field of Search ..... 252/56 R, 68, 52, 49.8, 252/58, 46.6; 558/265, 266

[56] References Cited

U.S. PATENT DOCUMENTS

| | | | |
|---|---|---|---|
| 2,758,975 | 8/1956 | Cottle et al. . | |
| 2,844,448 | 7/1958 | Heisler et al. | 252/56 R |
| 2,866,758 | 12/1958 | Newman et al. | 252/56 R |
| 5,009,803 | 4/1991 | Brandolese | 252/56 R |
| 5,114,605 | 5/1992 | Mizui et al. | 252/56 R |

FOREIGN PATENT DOCUMENTS

| | | |
|---|---|---|
| 0421298 | 4/1991 | European Pat. Off. . |
| 0435253 | 7/1991 | European Pat. Off. . |
| 0452816 | 10/1991 | European Pat. Off. . |
| 0499793 | 8/1992 | European Pat. Off. . |
| 9005172 | 5/1990 | World Int. Prop. O. . |

OTHER PUBLICATIONS

Database WPIL Week 9145, Derwent Publications Ltd., London, GB; AN 91-328026 & JP-A-03 217 495 (Idemitsu Kosan Company Limited) Sep. 25, 1991.

*Primary Examiner*—Jacqueline V. Howard
*Attorney, Agent, or Firm*—Sherman and Shalloway

[57] ABSTRACT

A polycarbonate lubricating oil composition which is resistant to decomposition of the polycarbonate and the generation of carbon dioxide gas. The lubricating oil composition contains a polycarbonate lubricant, at least one compound selected from the group of epoxy compound, phenol compound, sulfur compound and amine compound, and optionally a triester phosphite or a triester phosphate compound as inhibitors to the generation of carbon dioxide gas. The lubricating oil composition are stable, have excellent lubricating properties, cleaning properties, and electrical insulating properties, and their viscosity at low temperature can readily be lowered.

15 Claims, No Drawings

LUBRICATING OIL COMPOSITION

FIELD OF THE INVENTION

The present invention relates to lubricating oil compositions. More particularly, the invention relates to lubricating oil compositions excellent in lubricating properties, detergency and electrical insulation properties which can be used as industrial gear oils, automobile engine oils, automobile gear oils, lubricating oils for refrigerators, lubricating oils for rolling mills and lubricating oils for textile industry, for those oils the lubricating properties and the detergency being more severely required now than ever. Specifically, the invention relates to lubricating oil compositions most suitable as lubricating oils for refrigerators where hydrogenated fluorocarbon (HFC), hydrogenated chlorofluorocarbon (HCFC) or a mixture thereof is used as a refrigerant.

BACKGROUND OF THE INVENTION

Lubricating oils include, for example, industrial gear oils, engine oils, lubricating oils for refrigerators, lubricating oils for textile industry and lubricating oils for rolling mills.

Recently, the industrial gear oils have been desired to keep the lubricating properties and the detergency at higher temperature regions, as the environmental conditions under which various industrial machines are used have come to be more severe. Especially in baking paint process or baking food process, those oils have been desired to have higher performances in the lubricating properties and the detergency. In those areas, lubricating oils of synthetic hydrocarbon type, carboxylic ester type or glycol type have been conventionally employed.

The synthetic hydrocarbon type oils and carboxylic ester type oils, however, have such problems that they are insufficient in the lubricating properties and they cannot function as the lubricating oils at high temperatures because they are carbonized when heated for a long period of time. On the other hand, the glycol type lubricating oils have such a merit that they are hardly carbonized even when heated for a long period of time, but they are , insufficient in the lubricating properties and have high moisture absorption properties (hygroscopicity), so that these oils are desired to be improved in the lubricating properties and the resistance to moisture absorption.

The engine oils have been required to have lubricating properties and detergent-dispersing properties at higher temperatures for a long period of time, in accordance with enhancement in the performance of the automobile engines. In the case of using additives to comply with those requirements, the additives are necessarily used in a large amount, and hence a precipitation of a curdy (mayonnaise-like) sludge takes place. Further, a co-use of the synthetic hydrocarbon type oil or carboxylic ester type oil and a mineral oil as a base oil has been conventionally tried. However, the engine oil thus obtained is insufficient in both the lubricating properties and the detergent-dispersing properties at high temperatures for a long period of time.

Differently from the above-mentioned lubricating oils for automobile engines, namely, those for four-cycle engines, the lubricating oils for two-cycle engines are added to gasoline and subjected to combustion in the two-cycle engines, so that the detergency is particularly important for the lubricating oils for two-cycle engines. As the lubricating oils for two-cycle engines, there have been heretofore used a caster oil, polybutene, etc., but they are not sufficient both in the lubricating properties and the detergency.

The automobile gear oils, particularly gear oils for ATF, are necessary to be decreased in the friction coefficient and moreover to be reduced in a change of the friction coefficient with time. Therefore, an anti-friction agent or a friction-adjusting agent has been conventionally added to decrease the friction coefficient. However, the automobile gear oils containing these additives involve such a problem that a friction coefficient becomes larger during use.

As the lubricating oils for textile industry, those of carboxylic ester type or glycol type have been heretofore used, but they are not satisfactory both in the lubricating properties and the detergency.

As the lubricating oils for rolling mills, those containing beef tallow as the host component have been conventionally used. Such lubricating oils show good lubricating properties and excellent rolling efficiency. However, the detergency of these oils is markedly bad, so that a step of washing off the residual beef tallow is essential. Also used as the lubricating oils for rolling mills are those of carboxylic ester type, but these oils show poor lubricating properties, resulting in poor practicability, although they are very excellent in the detergency.

With the alteration of a refrigerant gas for refrigerators to R-134a ($CH_2F—CF_3$) which is nondestructive to the ozone layer, mineral oils or alkylbenzene compounds having been heretofore used as the lubricating oils for refrigerators have become unusable, because they have no compatibility with the refrigerant gas. Hence, glycol ether type lubricating oils have been now developed as the lubricating oils for refrigerators using the above-mentioned refrigerant gas.

For example, U.S. Pat. No. 4,755,316 discloses a composition for a compression refrigerator which comprises tetrafluoroethane and polyoxyalkylene glycol having a molecular weight of 300 to 2,000 and a kinematic viscosity at 37° C. of about 25 to 150 cSt.

However, there are pointed out such defects that this glycol ether type lubricating oil is generally insufficient in heat stability and high in hygroscopicity, and moreover it shrinks a rubber sealing material such as NBR to increase the hardness.

In refrigerators for automobile air conditioners a through-vane type rotary compressor which can make a size of the compressor smaller and increase power thereof has been used in recent years. As the lubricating oils for the through-vane type rotary compressor, those having a high viscosity is more desired than those having sealing properties and friction resistance. However, when compounds having glycol ether structure are increased in the molecular weight to have a high viscosity, the compatibility thereof with the ozone layer-nondestructive R-134a is generally deteriorated, so that such compounds cannot be employed from the structural viewpoint.

Further, carboxylic ester type lubricating oils called "polyol ester" and "hindered ester" have been developed recently as the lubricating oils for refrigerators where the ozone layer-nondestructive hydrogenated fluorocarbon (HFC) is used as a refrigerant. However, these lubricating oils are hydrolyzed or heat-decomposed to produce a carboxylic acid, and thus produced carboxylic acid causes a phenomenon of corrosion and abrasion of metals or a phenomenon of copper plating in the refrigerator. Therefore, an endurance of the refrigerator comes to be a problem in the case of using the lubricating oils stated above. Moreover, a part of the carboxylic acid produced by the hydrolysis or the heat decomposition is further decomposed under severe use conditions to generate a carbon dioxide gas. This carbon dioxide gas has non-condensation properties in an ordinary refrigerator system where fluorocarbon, chlorofluorocarbon or hydrogenation product thereof is used as a refrigerant, and hence decrease of refrigeration efficiency and temperature rise in the compression step are induced.

The ozone layer-nondestructive hydrogenated fluorocarbon (HFC) also includes concretely R-152a as well as the aforesaid R-134a. Also employable as the refrigerant is hydrogenated chlorofluorocarbon (HCFC) having a small destructive force to ozone, and this hydrogenated chlorofluorocarbon includes concretely, for example, R-22, R-123 and R-124. These hydrogenated chlorofluorocarbons are used singly or in combination with the hydrogenated fluorocarbons (HFC).

The present inventors have earnestly studied for the purpose of obtaining lubricating oils which are excellent in lubricating properties, detergency, electrical insulation properties and compatibility with both the hydrogenated fluorocarbons (HFC) and the hydrogenated chlorofluorocarbons (HCFC), and further which can prevent generation of the carboxylic acid and carbon dioxide gas. As a result, the present inventors have found that lubricating oil compositions excellent in the above-mentioned various properties can be obtained by blending a specific polycarbonate and at least one compound selected from the group consisting of an epoxy compound, a phenol compound, a sulfur compound and an amine compound in the specific amounts, or by blending a specific polycarbonate derived from sugars and a phosphorous triester compound in the specific amounts, and they have accomplished the present invention.

OBJECT OF THE INVENTION

The present invention is intended to solve such problems associated with the prior art as mentioned above, and an object of the invention is to provide lubricating oil compositions which are excellent in lubricating properties, detergency, electrical insulation properties and compatibility with both the hydrogenated fluorocarbons (HFC) and the hydrogenated chlorofluorocarbons (HCFC), and which can prevent generation of carboxylic acid and carbon dioxide gas.

More particularly, the object of the invention is to provide lubricating oil compositions which can be favorably used as the lubricating oils for refrigerators where ozone layer-nondestructive hydrogenated fluorocarbons (HFC) are used as refrigerants, such as an automobile air conditioner.

SUMMARY OF THE INVENTION

A first lubricating oil composition according to the invention comprises:

(1) a polycarbonate represented by the following formula [I] in an amount of 100 parts by weight;

(2) at least one compound selected from the group consisting of an epoxy compound (a), a phenol compound (b), a sulfur compound (c) and an amine compound (d), in an amount of 0.0001 to 5 parts by weight; and (3) a phosphorous triester compound (e) and/or a phosphoric triester compound (f), in an amount of 0 to 5 parts by weight, $$R_1OCOO[(R_2O)_pCOO]_nR_3 \qquad [I]$$

In the above formula [I], $R_1$ and $R_3$ are each independently a hydrocarbon group having 30 or less carbon atoms or a hydrocarbon group containing an ether bond and having 2–30 carbon atoms, $R_2$ is an alkylene group having 2–24 carbon atoms, p is an integer of 1 to 100, and n is an integer of 1 to 10.

A second lubricating oil composition according to the invention comprises:

(1) a polycarbonate represented by the following formula [II] in an amount of 100 parts by weight;

(2) a phosphorous triester compound (e) in an amount of 0.0002 to 5 parts by weight; and (3) at least one compound selected from the group consisting of a phosphoric triester compound (f), an epoxy compound (a), and a phenol compound (b), in an amount of 0 to 5 parts by weight, $$\text{Su-O-R} \qquad [II]$$

In the above formula [11], Su is a group represented by the following formula (A), and R is a group selected from the groups represented by the following formulas (B), $$[CH_2(OR_4)]CH[CH(OR_4)]_3CH- \quad \text{(A)}$$

$$[CH_2(OR_4)]CH[CH(OR_4)]_2C[CH_2(OR_4)]- \quad \text{(B)}$$

$$[CH_2(OR_4)]CH-O-[CH(OR_4)]_3CH- \quad \text{(C)}$$

$$CH(OR_4)[CH(OR_4)]_3CHCH_2- \quad \text{(D)}$$

$$-(C_3H_6O)_nCOOR_5 \quad \text{(E)}$$

$$-(C_3H_6O)_n(C_2H_4O)_pCOOR_5 \quad \text{(F)}$$

In the above formulas (A), (B), (C) and (D), $R_4$ is a group represented by the above formula (E) or (F).

In the above formulas (E) and (F), $R_5$ is a hydrocarbon group having 30 or less carbon atoms or a hydrocarbon group containing an ether bond and having 2–30 carbon atoms, and n and p are each an integer of 1 to 12.

A third lubricating oil composition according to the invention comprises:

(1) a polycarbonate represented by the following formula [III] in an amount of 100 parts by weight;

(2) a phosphorous triester compound (e) in an amount of 0.0002 to 5 parts by weight; and (3) at least one compound selected from the group consisting of a phosphoric triester compound (f), an epoxy compound (a), and a phenol compound (b), in an amount of 0 to 5 parts by weight, $$(R_4O)CH_2[CH(OR_4)]_mCH_2(OR_4) \qquad [III]$$

In the above formula [III], $R_4$ is a group represented by the following formula (E) or (F), and m is an integer of 1 to 6.

$$-(C_3H_6O)_nCOOR_5 \quad (E)$$

$$-(C_3H_6O)_n(C_2H_4O)_pCOOR_5 \quad (F)$$

In the above formulas (E) and (F), $R_5$ is a hydrocarbon group having 30 or less carbon atoms or a hydrocarbon group containing an ether bond and having 2–30 carbon atoms, and each of n and p is an integer of 1 to 12.

The first to third lubricating oil compositions according to the invention (sometimes referred to as simply "lubricating oil compositions" according to the invention) are excellent in lubricating properties, detergency and electrical insulation properties, and can be more easily decreased in the viscosity at low temperatures as compared with mineral oils and ester type lubricating oils. Therefore, the lubricating oil compositions according to the invention can be widely used as industrial gear oils, automobile engine oils, automobile gear oils, lubricating oils for refrigerators such as an automobile air conditioner and an electric refrigerator, lubricating oils for textile industry, lubricating oils for rolling mills, etc.

Further, the lubricating oil compositions according to the invention are excellent not only in the above-mentioned properties but also in a compatibility with hydrogenated fluorocarbons (HFC) having ozone layer-nondestructive properties and a compatibility with hydrogenated chlorofluorocarbons (HCFC) having a small destructive force to ozone. Therefore, the lubricating oil compositions according to the invention can be employed as lubricating oils for refrigerators where those hydrogenation products are used singly or in combination as refrigerant.

The lubricating oil compositions according to the invention may contain the aforesaid hydrogenated fluorocarbons (HFC) and hydrogenated chlorofluorocarbons (HCFC) and further mixtures thereof, and the lubricating oil compositions containing them can be also employed as the lubricating oils for refrigerators such as an automobile air conditioner and an electric refrigerator.

DETAILED DESCRIPTION OF THE INVENTION

The lubricating oil compositions according to the present invention are described in more detail hereinafter.

The first lubricating oil composition of the invention comprises a polycarbonate represented by the following formula [I] and at least one compound selected from the group consisting of an epoxy compound (a), a phenol compound (b), a sulfur compound (c) and an amine compound (d). This first lubricating oil composition may contain a phosphorous triester compound (e) and a phosphoric triester compound (f) in addition to the above-mentioned components.

The second lubricating oil composition of the invention comprises a polycarbonate represented by the following formula [II] and a phosphorous triester compound (e), and the third lubricating oil composition of the invention comprises a polycarbonate represented by the following formula [III] and a phosphorous triester compound (e). In some cases, each of the second and third lubricating compositions of the invention may contain at least one compound selected from the group consisting of a phosphoric triester compound (f), an epoxy compound (a) and a phenol compound (b), in addition to the above-mentioned components.

Next, each component of the lubricating oil compositions of the invention will be illustrated in detail.

POLYCARBONATE

The polycarbonate used as a lubricating base oil in the first lubricating oil composition of the invention is represented by the following formula [I]:

$$R_1OCOO[(R_2O)_pCOO]_nR_3 \quad [I]$$

In the above formula [I], $R_1$ and $R_3$ are each independently a hydrocarbon group having 30 or less carbon atoms or a hydrocarbon group containing an ether bond and having 2–30 carbon atoms.

Concrete examples of $R_1$ and $R_3$ include:

aliphatic hydrocarbon groups such as methyl group, ethyl group, n-propyl group, isopropyl group, n-butyl group, isobutyl group, s-butyl group, t-butyl group, pentyl group, isopentyl group, neopentyl group, n-hexyl group, 1,3-dimethylbutyl group, 2,3-dimethylbutyl group, isohexyl group, n-heptyl group, isoheptyl group, 3-methylhexyl group, n-octyl group, 2-ethylhexyl group, isooctyl group, n-nonyl group, isononyl group, n-decyl group, isodecyl group, n-undecyl group, isoundecyl group, n-dodecyl group, isododecyl group, n-tridecyl group, isotridecyl group, n-tetradecyl group, isotetradecyl group, n-pentadecyl group, isopentadecyl group, n-hexadecyl group, isohexadecyl group, n-heptadecyl group, isoheptadecyl group, n-octadecyl group, isooctadecyl group, n-nonadecyl group, isononadecyl group, n-eicosyl group, isoeicosyl group, 2-ethylhexyl group and 2-(4-methylpentyl) group;

alicyclic hydrocarbon groups such as cyclohexyl group, 1-cyclohexenyl group, methylcyclohexyl group, dimethylcyclohexyl group, decahydronaphthyl group and tricyclodecanyl group;

aromatic hydrocarbon groups such as phenyl group, o-tolyl group, p-tolyl group, m-tolyl group, 2,4-xylyl group, mesityl group and 1-naphthyl group;

aromatic aliphatic hydrocarbon groups such as benzyl group, methylbenzyl group, β-phenylethyl group (phenetyl group), 1-phenylethyl group, 1-methyl-1-phenylethyl group, p-methylbenzyl group, styryl group and cynnamyl group; and glycol ether groups represented by the general formula $-(R_6\text{-}O)_q\text{-}R_7$, such as ethylene glycol monomethyl ether group, ethylene glycol monobutyl ether group, diethylene glycol mono-n-butyl ether group, triethylene glycol monoethyl ether group, propylene glycol monomethyl ether group, propylene glycol monobutyl ether group, dipropylene glycol monoethyl ether group and tripropylene glycol mono-n-butyl ether group.

In the above formula $-(R_6\text{-}O)_q\text{-}R_7$, $R_6$ is an alkylene group of 2–3 carbon atoms. Concrete examples of such alkylene groups include ethylene group, propylene group and trimethylene group. $R_7$ is an aliphatic, alicyclic or aromatic hydrocarbon group of 28 or less carbon atoms. Concrete examples of such hydrocarbon groups include the same groups as exemplified above for $R_1$ and $R_3$ in the formula [I]. q is an integer of 1 to 20.

In the above formula [I], $R_2$ is an alkylene group of 2–24 carbon atoms. Concrete examples of such alkylene groups include ethylene group, propylene group, butylene group, amylene group, methylamylene group, ethylamylene group, hexylene group, methylhexylene group, ethylhexylene group, octamethylene group, nonamethylene group, decamethylene group, dodecamethylene group and tetradecamethylene group.

In the formula [I], p is an integer of 1 to 100, and n is an integer of 1 to 10.

When a polycarbonate represented by the above formula [I] is employed for a lubricating oil composition in a refrigerator where an ozone layer-nondestructive hydrogenated fluorocarbon such as R-134a is used as a refrigerant, $R_1$ in the formula [I] preferably is an alkyl group such as n-butyl group, isobutyl group, isoamyl group, cyclohexyl group, isoheptyl group, 3-methylhexyl group, 1,3-dimethylbutyl group, hexyl group, octyl group and 2-ethylhexyl group; or alkylene glycol monoalkyl ether group such as ethylene glycol monomethyl ether group, ethylene glycol monobutyl ether group, diethylene glycol monomethyl ether group, triethylene glycol monomethyl group, propylene glycol monomethyl ether group, propylene glycol monobutyl ether group, dipropylene glycol monoethyl ether group and tripropylene glycol mono-n-butyl ether group.

Examples of the polycarbonate represented by the formula [I] are given below.

(1) $R_1OCOO—CH_2CH_2CH(CH_3)CH_2CH_2—OCOOR_3$ (2) $R_1OCOO—CH_2CH(CH_3)(CH_2)_6—OCOOR_3$ (3) $R_1OCOO—(CH_2)_5—OCOOR_3$ (4) $R_1OCOO—(CH_2)_6—OCOOR_3$ (5) $R_1OCOO—(CH_2)_9—OCOOR_3$ (6) $R_1OCOO—(CH_2)_{10}—OCOOR_3$

In the above formulas (1) to (6), $R_1$ and $R_3$ are the same groups as those for $R_1$ and $R_3$ in the aforementioned formula [I].

The polycarbonates used as lubricating base oils of the second and third lubricating oil compositions according to the invention are represented by the following formula [II] and the following formula [III], respectively.

The polycarbonate represented by the following formula [II] includes sucrose type polycarbonate, oligosaccharide type polycarbonate other than sucrose and monosaccharide type polycarbonate.

$$\text{Su-O-R} \qquad [II]$$

In the above formula [II], Su is a group represented by the following formula (A), and R is a group selected from the groups represented by the following formulas (B), (C), (D), (E) and (F).

$$[CH_2(OR_4)]\underbrace{CH[CH(OR_4)]_3CH}_{O}— \qquad (A)$$

$$[CH_2(OR_4)]\underbrace{CH[CH(OR_4)]_2C[CH_2(OR_4)]}_{O}— \qquad (B)$$

-continued $$[CH_2(OR_4)]\underbrace{CH—O—[CH(OR_4)]_3CH}— \qquad (C)$$

$$\underbrace{CH(OR_4)[CH(OR_4)]_3CHCH_2}_{O}— \qquad (D)$$

$$—(C_3H_6O)_nCOOR_5 \qquad (E)$$

$$—(C_3H_6O)_n(C_2H_4O)_pCOOR_5 \qquad (F)$$

In the above formulas (A), (B), (C) and (D), $R_4$ is a group represented by the above formula (E) or (F).

In the above formulas (E) and (F), $R_5$ is a hydrocarbon group having 30 or less carbon atoms or a hydrocarbon group containing an ether bond and having 2–30 carbon atoms, and each of n and p is an integer of 1 to 12.

The polycarbonate represented by the following formula [III] is a polycarbonate derived from sugars not having a cyclic structure.

$$(R_4O)CH_2[CH(OR_4)]_mCH_2(OR_4) \qquad [III]$$

In the above formula [III], $R_4$ is a group represented by the above formula (E) or (F), and m is an integer of 1 to 6.

In the invention, a ratio of n to p (n/p) in the formula (F) is in the range of 0.5 to 20, preferably 1 to 10, more preferably 2 to 5.

Examples of the hydrocarbon groups indicated by $R_5$ in the formulas (E) and (F) include aliphatic hydrocarbon group, alicyclic hydrocarbon group, aromatic hydrocarbon group, aromatic aliphatic hydrocarbon group, and glycol ether group represented by the general formula $-(R_8\text{-}O)_q\text{-}R_9$ (wherein $R_8$ has the same meaning as that of the above-mentioned $R_6$ and is an alkylene group of 2–3 carbon atoms; $R_9$ has the same meaning as that of the above-mentioned $R_7$ and is a hydrocarbon group of 28 or less carbon atoms; and q is an integer of 1 to 20).

Concrete examples of the hydrocarbon groups indicated by $R_5$ include the same hydrocarbon groups as exemplified for $R_1$ and $R_3$ in the formula [I].

When the polycarbonate represented by the aforesaid formula [II] or [III] is employed for a lubricating oil composition in a refrigerator where an ozone layer-nondestructive hydrogenated fluorocarbon such as R-134a is used as a refrigerant, $R_5$ in the above formula (E) or (F) preferably is a lower alkyl group such as methyl group, ethyl group, isopropyl group and n-butyl group; or an alkylene glycol monoalkyl ether group such as ethylene glycol monomethyl ether group, ethylene glycol monobutyl ether group, diethylene glycol monomethyl ether group, triethylene glycol monomethyl ether group, propylene glycol monomethyl ether group, propylene glycol monobutyl ether group, dipropylene glycol monoethyl ether group and tripropylene glycol mono-n-butyl ether group.

Examples of the polycarbonate represented by the formula [II] are given below.

$$[CH_2(OR)]\underbrace{CH[CH(OR)]_3CH}_{O}—O—\underbrace{C[CH(OR)]_2CH}_{O}[CH_2(OR)] \qquad (1)$$

-continued

R in the above formula: $-[CH_2CH(CH_3)O]_nCOOCH_3$
[n = 1-3]

(2)

$$[CH_2(OR)]CH[CH(OR)]_3CH-O-\overset{\overset{CH_2(OR)}{|}}{C}[CH(OR)]_2CH[CH_2(OR)]$$

R in the above formula: $-[CH_2CH(CH_3)O]_nCOOCH_2CH(C_2H_5)-(CH_2)_3CH_3$
[n = 1.0-3.0]

(3)

$$[CH_2(OR)]CH[CH(OR)]_3CH-O-\overset{\overset{CH_2(OR)}{|}}{C}[CH(OR)]_2CH[CH_2(OR)]$$

R in the above formula: $-[CH_2CH(CH_3)O]_nCOOCH(CH_3)_2$
[n = 1-3]

(4)

$$[CH_2(OR)]CH[CH(OR)]_3CH-O-CH[CH(OR)]_3OCH[CH_2(OR)]$$

R in the above formula: $-[CH_2CH(CH_3)O]_nCOOCH_3$
[n = 1-3]

(5)

$$[CH_2(OR)]CH[CH(OR)]_3CH-O-CH[CH(OR)]_3OCH[CH_2(OR)]$$

R in the above formula: $-[CH_2CH(CH_3)O]_nCOOCH_2CH(C_2H_5)-(CH_2)_3CH_3$
[n = 1.0-3.0]

(6)

$$[CH_2(OR)]CH[CH(OR)]_3CH-O-CH[CH(OR)]_3OCH[CH_2(OR)]$$

R in the above formula: $-[CH_2CH(CH_3)O]_nCOOCH(CH_3)_2$
[n = 1-3]

(7)

$$[CH_2(OR)]CH[CH(OR)]_3CH-O-CH_2CH[CH(OR)]_3CH(OR)$$

R in the above formula: $-[CH_2CH(CH_3)O]_nCOOCH_3$
[n = 1-3]

(8)

$$[CH_2(OR)]CH[CH(OR)]_3CH-O-CH_2CH[CH(OR)]_3CH(OR)$$

R in the above formula: $-[CH_2CH(CH_3)O]_nCOOCH_2CH(C_2H_5)-(CH_2)_3CH_3$
[n = 1.0-3.0]

(9)

$$[CH_2(OR)]CH[CH(OR)]_3CH-O-CH_2CH[CH(OR)]_3CH(OR)$$

R in the above formula: $-[CH_2CH(CH_3)O]_nCOOCH(CH_3)_2$
[n = 1-3]

(10)

$$[CH_2(OR)]CH[CH(OR)]_3CH-O-R$$

R in the above formula: $-[CH_2CH(CH_3)O]_nCOOCH_3$
[n = 1-3]

(11)

$$[CH_2(OR)]CH[CH(OR)]_3CH-O-R$$

R in the above formula: $-[CH_2CH(CH_3)O]_nCOOCH_2CH(C_2H_5)-(CH_2)_3CH_3$
[n = 1.0-3.0]

(12)

$$[CH_2(OR)]CH[CH(OR)]_3CH-O-R$$

-continued

R in the above formula: $-[CH_2CH(CH_3)O]_nCOOCH(CH_3)_2$
[n = 1-3]

$[CH_2(OR)]CH[CH(OR)]_3CH-O-R$ (13)
$\quad\quad\quad ber of moles of the carbonate compound, $m_2$ number of moles of diol) is in the range of 0.5 to 200.

$$R_5OCOOR_5 \quad [VIII]$$

wherein $R_5$ is the same as $R_5$ in the aforementioned formulas (E) and (F).

In the case of using this carbonate compound, a boiling point of $R_5OH$ is lower than that of the above-mentioned polyol, and a molar ratio of this carbonate compound to polyol represented by the formula [V] or [VI] is in the range of 3 to 80.

For carrying out the above reaction, the reactor is desirably purged with nitrogen, but the reactor may not be purged with nitrogen.

In the next place, the above-mentioned basic catalyst is removed, and then the unreacted carbonate compound is distilled off from the reaction system, to obtain a polycarbonate represented by the aforesaid formula [I], [II] or [III].

In this process, a polycarbonate in which all hydroxyl groups of the polyol (starting material) are carbonated is produced, but there is a possibility that a polycarbonate in which some hydroxyl groups of the polyol are carbonated is produced in a small amount.

The above-mentioned diol is represented by the following formula [IV]:

$$R_2(OH)_2 \quad [IV]$$

wherein $R_2$ is the same as $R_2$ in the aforesaid formula [I].

The above-mentioned polyol is represented by the following formula [V]:

$$Su\text{-}O\text{-}R_{10} \quad [V]$$

wherein Su is a group represented by the following formula (G), and $R_{10}$ is a group selected from the groups represented by the following formulas (H), (I), (J), (K) and (L).

$$[CH_2(OR_{11})]CH[CH(OR_{11})]_3CH- \quad (G)$$
$$\quad\quad\quad wherein $R_{11}$ is a group represented by the aforementioned formula (K) or (L), and m is an integer of 1 to 6.

Concrete examples of the polyol represented by the formula [VI] are polyols represented by the following formulas. In those formulas, n is an integer of 1 to 12.

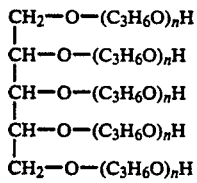

(1)

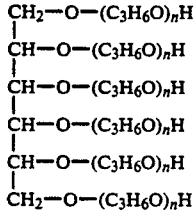

(2)

Polyols obtained by substituting the $-(C_3H_6O)_nH$ group of the above formulas (1) and (2) with a $-(C_3H_6O)_n(C_2H_4O)_pH$ group, respectively.

Preferred examples of the carbonate compounds represented by the aforesaid formulas [VII] and [VIII] include concretely dimethyl carbonate, diethyl carbonate, dipropyl carbonate, dibutyl carbonate, di-[1,3-dimethylbutyl]carbonate, diisoamyl carbonate, dihexyl carbonate, dioctyl carbonate, dicyclohexyl carbonate, di-3-methylhexyl carbonate, di-2-ethylhexyl carbonate and di(2-methyl-methoxyethyl)carbonate.

In this process, the carbonation reaction is proceeded while distilling off alcohol produced in the carbonation reaction from the reaction system, and hence a boiling point of thus produced alcohol, that is, alcohol represented by $R_1OH$, $R_3OH$ or $R_5OH$, is required to be lower than a boiling point of the above-mentioned diol or polyol.

Further, the carbonate compound represented by the formula [VII] is used in such an amount that the aforementioned ratio $m_1/2m_2$ would be in the range of 0.5 to 200, preferably 1 to 80, more preferably 1 to 50.

On the other hand, the carbonate compound represented by the formula [VIII] is used in such an amount that a molar ratio of this carbonate compound to the polyol represented by the formula [V] or [VI] would be in the range of 3 to 80, preferably 3 to 50.

By using the specific amount of the carbonate compound as above, production of a polycarbonate having high polymerization degree can be restrained.

In this process, the above-described diol (or polyl) and carbonate compound are charged in a reactor, then they are heated in the presence of a basic catalyst to react them with each other until a reaction conversion of not less than 95% attained, while distilling off the produced alcohol from the reaction system, followed by removing the basic catalyst, and then the unreacted carbonate compound is distilled off from the reaction system. The expression "reaction conversion of not less than 95% attained" means that the reaction is proceeded until the alcohol ($R_1OH$ or $R_3OH$) is produced in an amount of not less than 0.95 time mole of the aforementioned $2m_2$, or that the reaction is proceeded until the alcohol ($R_5OH$) is produced in an amount of not less than 0.95 time mole of the mole number of the polyol represented by the formula [V] or [VI].

Examples of the basic catalysts preferably used in the invention include alkali metal hydroxides such as sodium hydroxide and potassium hydroxide; alkali metal carbonates or hydrogen carbonates such as sodium carbonate and sodium bicarbonate; alkali metal alcoholates such as sodium methoxide, potassium methoxide, lithium methoxide and cesium methoxide; and alkali metal compounds such as sodium hydride and sodium amide. Of these, alkali metal alcoholates are particularly preferred. Also employable are, for example, alkaline earth metal compounds such as magnesium hydroxide and calcium hydroxide; and organoamino compounds such as trimethylamine, triethylamine, imidazole and tetramethylammonium hydroxide. The catalyst is used in such an amount that a ratio of the mole number of the catalyst to the aforesaid $2m_2$, or a ratio of the mole number of the catalyst to the mole number of the polyol (molar ratio), would be in the range of usually $10^{-1}$ to $10^{-7}$, preferably $10^{-2}$ to $10^{-5}$.

In this process, the temperature for the reaction is in the range of generally 50° to 300 ° C., preferably 60° to 200 ° C., and the reaction time for the reaction is in the range of generally 0.5 to 200 hours, preferably 1 to 100 hours.

After the completion of the reaction, the catalyst is removed by washing the reaction solution with water or neutralizing it with an acid. Examples of the acids used herein include solid acids such as sulfonic acid type ion exchange resin; inorganic acids such as carbonic acid, ammonium chloride, hydrochloric acid, sulfuric acid and phosphoric acid; and organic acids such as acetic acid and phenol. In the washing procedure, a salt such as ammonium carbonate may be added.

The basic catalyst is removed as mentioned above, and then the unreacted carbonate compound is distilled off from the reaction system under a reduced pressure, whereby polymerization of a polycarbonate produced can be prevented when the unreacted carbonate compound is distilled off from the reaction system in the presence of a basic catalyst, and hence the aimed polycarbonate can be obtained in a high yield.

The polycarbonate obtained as above may be treated with an adsorbent such as active clay and activated carbon, or may be washed with water, to remove impurities existing in a trace amount. Through such treatment, an ionic compound or a polar compound existing in a trace amount can be removed, so that the resulting polycarbonate can be stably preserved.

According to the process as described above, in the case where dimethyl carbonate is used as the carbonate compound in the above-mentioned reaction, methanol may be distilled off from the reaction system in the form of an azeotrope with an azeotropic solvent such as cyclohexane, benzene or hexane after the azeotropic solvent is previously added to the reaction system, instead of distilling off the methanol from the reaction system as an azeotrope with dimethyl carbonate. In this case, the azeotropic solvent is used in an amount of generally 5 to 100 parts by weight per 100 parts by weight of dimethyl carbonate.

Furthermore, according to the above process, methanol is distilled off from the reaction system as an azeotrope with the above-mentioned azeotropic solvent, and after completion of the reaction, the unreacted dimethyl carbonate is recovered from the reaction mixture, so that a recovery of the unreacted dimethyl carbonate can be increased.

Otherwise, it is possible that methanol is recovered as an azeotrope with dimethyl carbonate as described above, then to the resulting azeotrope is added the above-mentioned azeotropic solvent, and methanol is distilled off as an azeotrope with the azeotropic solvent from dimethyl carbonate, to recover dimethyl carbonate.

Moreover, according to the process stated above, after the reaction of diol (or polyol) and a carbonate compound is completed, a basic catalyst is removed, and thereafter the unreacted carbonate compound is removed, so that the aimed polycarbonate can be obtained in a high yield.

Next, the second process for preparing a polycarbonate is described in detail.

In the first place, (a) a diol represented by the above formula [IV] or a polyol represented by the above formula [V] or [VI], (b) a monoalcohol represented by the following formula [IX] or [X] and (c) a carbonate compound represented by the following formula [XI] or [XII] are heated in the presence of a basic catalyst to react them with each other until a reaction conversion of not less than 95% attained, while distilling off the produced alcohol ($R_{12}OH$ or $R_{13}OH$) from the reaction system. For carrying out the above reaction, the reactor is desirably purged with nitrogen, but the reactor may not be purged with nitrogen.

$$R_1OH \text{ or } R_3OH \quad [IX]$$

wherein $R_1$ and $R_3$ have the same meanings as those of $R_1$ and $R_3$ in the aforesaid formula [I].

$$R_5OH \quad [X]$$

wherein $R_5$ is the same as $R_5$ in the aforesaid formula [III], and is a hydrocarbon group having 30 or less carbon atoms or a hydrocarbon group containing an ether bond and having 2–30 carbon atoms.

$$R_{12}OCOOR_{12} \quad [XI]$$

wherein $R_{12}$ is each independently an alkyl group of 1–12 carbon atoms.

In the case of using this carbonate compound, a boiling point of $R_{12}OH$ is lower than that of the above-mentioned diol and monoalcohol, and a ratio of $m_1/2m_2$ ($m_1$: number of moles of the carbonate compound, $m_2$: number of moles of diol) is in the range of 0.5 to 200.

$$R_{13}OCOOR_{13} \quad [XII]$$

wherein $R_{13}$ is each independently an alkyl group of 1–2 carbon atoms.

In the case of using this carbonate compound, a boiling point of $R_{13}OH$ is lower than that of the above-mentioned polyol and monoalcohol, and a molar ratio of this carbonate compound to polyol represented by the formula [V] or [VI] is in the range of 3 to 80.

In the next place, the above-mentioned basic catalyst is removed, and then the unreacted carbonate compound and a carbonate compound which has not participated to the final reaction stage [$R_{14}OCOOR_{14}$ (wherein $R_{14}$ is each independently the above-mentioned $R_1$, $R_3$ or $R_{12}$), or $R_{13}OCOOR_{13}$] are distilled off from the reaction system, to obtain a polycarbonate represented by the aforesaid formula [I], [II] or [III].

Also in this process, a polycarbonate in which all hydroxyl groups of the polyol (starting material) are carbonated is produced, but there is a possibility that a polycarbonate in which some hydroxyl groups of the polyol are carbonated is produced in a small amount.

In this process, the carbonation reaction is proceeded while distilling off alcohol produced in the carbonation reaction from the reaction system, and hence a boiling point of thus produced alcohol, that is, alcohol represented by $R_{12}OH$ or $R_{13}OH$, is required to be lower than a boiling point of the above-mentioned diol (or polyol) and monoalcohol. The carbonate compound represented by the formula [XI] is used in such an amount that the aforementioned ratio $m_1/2m_2$ would be in the range of 0.5 to 200, preferably 1 to 80, more preferably 1 to 50. On the other hand, the carbonate compound represented by the formula [XII] is used in such an amount that a molar ratio of this carbonate compound to the polyol represented by the formula [V] or [VI] would be in the range of 3 to 80, preferably 3 to 50. By using the specific amount of the carbonate compound as above, production of a polycarbonate having high polymerization degree can be restrained.

In this process, the above-described diol (or polyol), monoalcohol and carbonate compound are charged in a reactor, then they are heated in the presence of a basic catalyst to react them with each other until a reaction conversion of not less than 95 % attained, while distilling off the produced alcohol from the reaction system, followed by removing the basic catalyst, and then the unreacted carbonate compound is distilled off from the reaction system.

The meaning of the above expression "reaction conversion of not less than 95% attained" is the same as described before. Further, the basic catalyst, reaction temperature, reaction period, removal of the catalyst after completion of the reaction, removal of the impurities, and recovery of the unreacted dimethyl carbonate in this second process are the same as those in the first process described before.

In the first process for preparing a polycarbonate described before, carbonate compounds other than dimethyl carbonate and diethyl carbonate represented by the formula [VII] and [VIII] are hardly available, so that they are required to be beforehand synthesized. However, in the second process, polycarbonates can be prepared using the easily available carbonate compounds represented by the formula [XI] and [XII] (dimethyl carbonate, diethyl carbonate, ethylmethyl carbonate). Accordingly, the second process does not need to synthesize the carbonate compounds, and this is an economical process Similarly to the first process described before, polycarbonate can be obtained in a high yield according to this second process.

EPOXY COMPOUND (A)

Concrete examples of the epoxy compounds (a) include:

glycidyl ethers such as phenyl glycidyl ether, tolyl glycidyl ether, xylyl glycidyl ether, butyl glycidyl ether, 2-ethylhexyl glycidyl ether, sec-butylphenol glycidyl ether, 2-methyloctyl glycidyl ether, n-decyl glycidyl ether, diglycidyl ether and diglycidyl ether of bisphenol A;

glycidyl esters such as glycidyl acetate, glycidyl laurate, glycidyl palmitate, glycidyl stearate and glycidyl oleate; and epoxidized hydrocarbons such as epoxidized octyl stearate, epoxidized soybean oil, epoxidized cyclohexane, epoxidized dicyclopentadiene and epoxidized dihydrodicyclopentadiene.

Of these, particularly preferred are epoxidized octyl stearate, phenyl glycidyl ether and tolyl glycidyl ether.

PHENOL COMPOUND (B)

Concrete examples of the phenol compounds (b) include 1,3,5-trimethyl-2,4,6-(3,5-di-t-butyl-4-hydroxyphenyl) methylbenzene, tetramethylene-3-(3,5-di-t-butyl-4-hydroxyphenyl)propionate]methane, t-butylated hydroxytoluene, p-hydroxyanisole, 3-methyl-4-isopropylphenol, 2-t-butyl-4,6-dimethylphenol, 2-t-butyl-4-methoxyphenol, 2,6-di-t-butylphenol, propyl gallate, styrenated cresol, 2-(1-methylcyclohexyl)-4,6-dimethylphenol, 2,4-di-t-butyl-5-methylphenol, 2,6-di-t-butyl-4-hydroxytoluene, 3,5-di-t-butyl-4-hydroxytoluene, 4,4'-thio-bis(2-methyl-6-t-butylphenol) and 2,2'-thio-bis(4-methyl-6-t-butylphenol).

Of these, 3,5-di-t-butyl-4-hydroxytoluene, 2,6-di-t-butyl-4-hydroxytoluene and tetra[methylene-3-(3,5-di-t-butyl-4-hydroxyphenyl)propionate]methane are particularly preferred for the first lubricating oil composition of the invention.

On the other hand, t-butylated hydroxytoluene, 2,6-di-t-butylphenol and styrenated cresol are particularly preferred for the second and third lubricating oil compositions of the invention.

SULFUR COMPOUND (C)

Concrete examples of the sulfur compounds (c) include mercaptobenzimidazole, phenothiazine, N,N'-diphenylthiourea, tetramethylthiuram disulfide, N-oxydiethylene-2-benzothiazolylsulfenamide, N-cyclohexyl-2-benzothiazolylsulfenamide, 2-mercaptobenzothiazole/cyclohexylamine salt, N,N'-diisopropyl-2-benzothiazolylsulfenamide, 2-(N,N-diethylthiocarbonylthio)benzothiazole, tetraethylthiuram disulfide, dibenzothiazolyl disulfide, zinc diethyldithiocarbamate, zinc ethylphenyldithiocarbamate, zinc di-n-butylthiocarbamate, dilauryl thiodipropionate, dilauryl thiodi-1,1'-methylbutyrate, dimyristyl-3,3'-thiodipropionate, laurylstearyl thiodipropionate, distearyl thiodipropionate, distearyl thiodibutyrate, penta(erythrityl-tetra-$\beta$-mercaptolauryl)propionate, dioctadecyl disulfide, and 4,4'-thio-bis(3-methyl-6-t-butylphenol).

Of these, dilauryl thiodipropionate and 4,4'-thiobis(3-methyl-6-t-butylphenol) are particularly preferred.

AMINE COMPOUND (D)

Concrete examples of the amine compounds (d) include phenyl-1-naphthylamine, N,N'-diphenyl-p-phenylenediamine, 4,4'-bis($\alpha$,$\alpha$-dimethylbenzyl)diphenylamine, N,N'-di-$\beta$-naphthyl-p-phenylenediamine, 2,2,6,6-tetramethyl-4-piperidine methyl methacrylate, bis(2,2,6,6-tetramethyl-4-piperidyl)oxalate, 1,2,2,6,6-pentamethyl-4-piperidine methyl methacrylate and bis(1,2,2,6,6-pentamethyl-4-piperidyl)sebacate.

Of these, 4,4'-bis($\alpha$,$\alpha$-dimethylbenzyl)diphenylamine is particularly preferred.

PHOSPHOROUS TRIESTER COMPOUND (E)

Concrete examples of the phosphorous triester compounds (e) include triisodecyl phosphite, trioctyl phosphite, tricresyl phosphite, triphenyl phosphite, diphenyloctyl phosphite, diphenyldecyl phosphite, phenyldidecyl phosphite and 1,1,3-tri(2-methyl-4-ditridecylphosphite-5-t-butylphenyl)butane.

Of these, phenyldidecyl phosphite and diphenyldecyl phosphite are particularly preferred for the first lubricating oil composition of the invention.

On the other hand, tricresyl phosphite and diphenyloctyl phosphite are particularly preferred for the second and third lubricating oil compositions of the invention.

PHOSPHORIC TRIESTER COMPOUND (F)

Concrete examples of the phosphoric triester compounds (f) include triphenyl phosphate, tricresyl phosphate, trioctyl phosphate and 1,1,3-tris(2-methyl-4-ditridecylphosphate-5-tert-butylphenyl)butane.

Of these, triphenyl phosphate and tricresyl phosphate are particularly preferred for the first lubricating oil composition of the invention.

On the other hand, tricresyl phosphate and 1,1,3-tris(2-methyl-4-ditridecylphosphate-5-tertbutylphenyl)-butane are particularly preferred for the second and third lubricating oil compositions of the invention.

AMOUNTS OF COMPONENTS (A) TO (F)

The amounts of the aforementioned components (a) to (f) used in the first lubricating oil composition of the present invention are as follows.

Each of the epoxy compound (a), the phenol compound (b), the sulfur compound (c) and the amine compound (d) is used in an amount of 0.0001 to 5 parts by weight, preferably 0.01 to 3.0 parts by weight, more preferably 0.02 to 2.0 parts by weight, based on 100 parts by weight of the polycarbonate represented by the aforesaid formula [I].

These compounds (a) to (d) can be used singly or in combination.

Each of the phosphorous triester compound (e) and the phosphoric triester compound (f) is used in an amount of 0 to 5 parts by weight, preferably 0.01 to 3.0 parts by weight, more preferably 0.02 to 2.0 parts by weight, based on 100 parts by weight of the polycarbonate represented by the aforesaid formula [I].

These compounds (e) and (f) are optional components, and they are used singly or in combination.

The amounts of the components (e), (f), (a) and (b) used in the second and third lubricating oil compositions of the present invention are as follows.

The phosphorous triester compound (e) is used in an amount of 0.0002 to 5 parts by weight, preferably 0.01 to 3.0 parts by weight, more preferably 0.02 to 2.0 parts by weight, based on 100 parts by weight of the polycarbonate represented by the aforesaid formula [II] or [III].

Each of the phosphoric triester compound (f), the epoxy compound (a), and the phenol compound (b) is used respectively in an amount of 0 to 5 parts by weight, preferably 0.01 to 3.0 parts by weight, more preferably 0.02 to 2.0 parts by weight, based on 100 parts by weight of the polycarbonate represented by the aforesaid formula [II] or [III].

These compounds (f), (a) and (b) are optional components, and they are used singly or in combination.

The polycarbonate having a carbonate bond, which is used as a lubricating base oil in the invention, generates carbon dioxide gas in a very small amount under severe use conditions. In general, the carbon dioxide gas is non-condensative in the ordinary refrigerator system where fluorocarbon, chlorofluorocarbon or hydrogenation product thereof is used as a refrigerant, and thereby decrease of refrigeration efficiency and temperature rise in the compression step are brought about. Therefore, it is said that use of polycarbonates is unfavorable. The present inventors have studied on a great number of additives capable of preventing generation of the carbon dioxide gas, and found that the above-mentioned epoxy compound (a), phenol compound (b), sulfur compound (c), amine compound (d), phosphorous triester compound (e) and phosphoric triester compound (f) are remarkably effective as such additives.

Further, the present inventors have also found that the epoxy compound (a), the phenol compound (b), the sulfur compound (c) and the amine compound (d) are preferred in the case of using the polycarbonate represented by the formula [I] as a lubricating base oil, and the phosphorous triester compound (e) is preferred in the case of using the polycarbonate represented by the formula [II] or [III] as a lubricating base oil.

Furthermore, the present inventors have found the above-described compounds (a) to (f) contribute to the enhancement of the lubricating properties.

Based on the findings stated above, the present inventors have accomplished the present invention.

OTHER OPTIONAL COMPONENTS

The lubricating oil compositions of the present invention may contain other components in addition to the above polycarbonate, epoxy compound (a), phenol compound (b), sulfur compound (c), amine compound (d), phosphorous triester compound (e) and phosphoric triester compound (f).

For example, in the case of using the lubricating oil compositions of the invention as the industrial gear oils, automobile engine oils or the automobile gear oils, neutral oil or bright stock may be added to the lubricating oil compositions. Further, also may be added to the lubricating oil compositions are α-olefin oligomers such as liquid polybutene and liquid decene oligomer; esters of carboxylic acid such as diisooctyl adipate, diisooctyl sebacate, dilauryl sebacate, 2-ethylhexanoic acid tetraesters of pentaerythritol and hexanoic triester of trimethylolpropane; and vegetable oils. Moreover, conventionally known additives for lubricating oils, for example, those described in Toshio Sakurai "Additives for Petroleum Products" (published by Saiwai Shobo, 1974), such as detergent-dispersing agents, antioxidants, load-resistant additives, oily agents and pour-point decreasing agents may be added to the lubricating oil compositions, with the proviso that the objects of the invention are not marred.

In the case of using the lubricating oil compositions of the invention as lubricating oils for refrigerators, especially in the case of using them for refrigerators where hydrogenated fluorocarbon (HFC) is used as a refrigerant gas, the components which can be added to the lubricating oil compositions are especially preferred to glycol ethers and esters of carboxylic acid from the viewpoint of compatibility. The amount of those components is required to be less than 60% by weight based on 100% by weight of the total amount of the lubricating oil composition, because an excess amount thereof deteriorates heat resistance, compatibility with R-134a and hygroscopicity. Also may be added to the lubricating oil compositions are the above-mentioned conventionally known additive for lubricating oils. Moreover, in the lubricating oils for refrigerators hydrogenated fluorocarbons (HFC) having ozone layer-nondestructive properties such as R134a, hydrogenated chlorofluorocarbons (HCFC) having a small destructive force to ozone such as R-22 and hydrogenation products thereof may be used.

In the case of using the lubricating oil compositions of the invention as lubricating oils for rolling mills, metal processing oils, lubricating oils for textile industry, etc., the aforementioned polycarbonate may be used in the form of emulsion with water obtained by using an appropriate emulsifying agent, as carried out in the conventional manner.

EFFECT OF THE INVENTION

The lubricating oil compositions according to the invention have such effects that they are excellent in lubricating properties, detergency, electrical insulation properties, and that they can be easily decreased in the viscosity at low temperatures as compared with mineral oils and ester type lubricating oils.

Further, the lubricating oil compositions according to the invention have such effect that they can prevent generation of carboxylic acid and carbon dioxide gas caused by polycarbonates.

Accordingly, the lubricating oil compositions according to the invention can be widely used as industrial gear oils, automobile engine oils, automobile gear oils, lubricating oils for refrigerators such as an air conditioner and an electric refrigerator, lubricating oils for textile industry, lubricating oils for rolling mills, etc.

Since the lubricating oil compositions according to the invention are excellent not only in the above-mentioned properties but also in the compatibility with hydrogenated fluorocarbons (HFC) which are nondestructive to the ozone layer and the compatibility with hydrogenated chlorofluorocarbons (HCFC) which have a small destructive force to ozone, they can be suitably used as lubricating oils for refrigerators (e.g., automobile air conditioner and electric refrigerator) where those hydrogenation products are used singly or in combination as refrigerant.

The present invention is further described below referring to the following examples, but the invention is in no way limited to those examples.

Analyses of the polycarbonates and the control materials and performance evaluations of the lubricating oil compositions in Examples with respect to the first lubricating oil composition of the invention and Comparative Examples thereof are made in accordance with the following test methods.

TEST METHOD a. Kinematic viscosity JIS K-2283 b. Viscosity index JIS K-2283 c. Load bearing capacity

After a 5-minute warming-up operation under a load of 250 lbf using a Falex tester, the load is increased continuously, and a value of the increased load obtained, at which burn markings have appeared, is taken as a value of load bearing capacity.

d. Concentration of carbon dioxide gas

For gas sampling, an autoclave of 50 cc in capacity, the upper part of which has been provided by welding a sample pouring-spout of a gas chromatography, is charged with 25 g of a sample oil, and the autoclave is sealed in a nitrogen atmosphere. Subsequently, the autoclave is heated by means of a thermostatic oil bath controlled at 175° C., and after 7 hours heating, 1 cc of a gas phase present in the autoclave is collected through the gas sampling sprout provided on the upper part of the autoclave by means of a gas syringe, and a concentration of $CO_2$ generated from the sample oil is measured by gas chromatography under the following conditions.

Column : Activated carbon column 6 m
Column temperature : 165° C.
Carrier gas : He
Rate of of carrier gas feeding: 40 ml/min
Detector : TCD e. Compatibility with Freon R-134a (1) A test tube of 10 mm in inside diameter and 20 cm in depth is charged with 1 ml of the specimen and, while cooling the test tube on a dry ice/acetone bath, Freon R-134a a is introduced gradually into the test tube from a bomb and stored so as to reach a volume slightly larger than that of the specimen. The mixture in the test tube is then stirred by means of a spatula, and the test tube is transferred onto a cooling bath kept at −20° C. to investigate a solubility of the specimen in Freon R-134a at the time when the volume ratio of the specimen/Freon 134a has become 1/1. At the time of the investigation, when the resulting mixture is a perfectly homogeneous solution, the rating is taken as o, and when the specimen does not dissolve in Freon 134a, the rating is taken as x.

(2) In order to investigate the solubility of the carbonate product in Freon 134a more in detail, the lubricating and Freon 134a are encapsulated in various proportions into a glass tube to obtain a critical temperature at which the two compounds become compatible with each other.

(3) In a 200 ml pressure glass cylinder is taken 5 g of the sample oil, followed by vacuumizing. To the cylinder is added 95 g of Freon R-134a, and is thoroughly mixed with the sample oil to evaluate the compatibility of the two compounds. When this thorough mixture is transparent at a temperature in the range of 15° to −30° C., the compatibility is judged to be acceptable.

In the following examples and comparative examples regarding the second and third lubricating oil compositions of the present invention, the results of analysis and evaluation of performance of the polycarbonates were obtained by the test methods mentioned below.

(1) ANALYTICAL METHOD a. Average molecular weight

Using a GPC system of Shimadzu Seisakusho Ltd., the average molecular weight of the polycarbonate obtained was determined on the basis of polystyrene. The conditions under which the average molecular weight is determined are as follows:

Column : Four (4) pieces of polystyrene gel (G-2000HXL+G-2000HXL+G-3000HXL+G-4000HXL)
Sensor : Differential refractometer
Temperature : 40° C.
Solvent : Tetrahydrofuran
Rate of elution : 0.7 ml/min b. Infrared absorption spectrum The determination is conducted using the specimen spread between KBr plates by means of an infrared spectrometer A-302 manufactured and sold by Nippon Bunkoh K.K.

c. NMR analysis

The n value in the formula [E] representing $R_4$ in the general formulae [II] and [III] is obtained by the proton NMR method [JNM-GX270 manufactured and sold by Nippon Densi K.K.].

(2) Evaluation method a. Kinematic viscosity

Same as the above-mentioned method.

b. Load bearing capacity

Same as the above-mentioned method.

c. Frictional characteristics

The measurement of the friction coefficient was carried out using a SRV friction tester of Optimol under the following conditions.

Load : 100N
Temperature : 100° C.
Time : 10 minutes
Vibrational amplitude : 1 mm
Number of vibration : 50 Hz
Specimen : Combination of a circular plate and a sphere, both being made of SUJ-2

The abrasion trace is determined by measuring the depth of abrasion traces on the circular plate after the test by means of a surface roughness meter (SURFCOM 2000 of Tokyo Seimitsu K K.).

d. Heat stability

A 100 cc beaker charged with 20 g of the specimen is heated at 170° C. for 6.5 hours in an oven to evaluate the heat stability by measuring the rate of change in weight before and after the heating and rate of change in kinematic viscosity at 100° C. and of the total acid value. The smaller are the rate of change and total acid, the more excellent is the heat stability.

e. Compatibility with Freon R-134a

Same as the above-mentioned method.

f. Concentration of carbon dioxide gas

To the opening of a test tube (inside diameter 22 mm, depth 20 cm) charged with 10 g of the sample oil is fitted a rubber stopper into which a T-type glass tube has been inserted, said glass tube having a gas introducing tube at its center portion in the lengthwise direction and a gas collecting bag fitted to one end while the other end being open, thereby sealing the test tube. Subsequently, after deaerating the air in the test tube and glass tube through the gas introducing tube, 500 ml of nitrogen gas of ordinary pressure is injected into this test tube. The test tube is heated at 175° C. for 24 hours by means of a thermostatic oil bath, and the gas present in the test tube is collected to measure the concentration in the collected gas of $CO_2$ gas generated by decomposition of the sample oil by means of a gas chromatography under the following conditions.

Column: Parapak-Q, 3 m
Column temperature: 50° C.
Carrier gas: He
Feed rate of carrier gas: 40 ml/min
Detector TCD g. Volume resistivity The volume resistivity is obtained in accordance with ASTM D 257.

[Referential example, examples and comparative example of the first lubricating oil composition of the present invention]

REFERENTIAL EXAMPLE 1

A 5-liter flask equipped with a distillation column of a 10-sieve tray was charged with 588 g (4.98 mol) of 3-methyl-1,5-pentadiol, 2,500 g (21.42 mol) of methylhexanol (a mixture consisting of 87% of 3-methyl body and 13% of 5-methyl body), 1932 g (21.45 mol) of dimethyl carbonate and 3.8 g (0.020 mol) of a methanol solution of 28% by weight of $NaOCH_3$.

This mixture was heated at 110°–160° C. for 8 hours at atmospheric pressure to distill off the resulting methanol. The yield of the methanol was 98%.

Subsequently, this mixture was allowed to undergo reaction for 8 hours by heating at 130°–170° C. under reduced pressure (130–10 mmHg) to distill off methanol, dimethyl carbonate, methylhexanol and methylmethylhexyl carbonate.

After washing the thus obtained mixture with an aqueous solution containing ammonium carbonate in an amount of five times the molar quantity of the $NaOCH_3$ used and then with water, an excess dimethylhexyl carbonate was removed by distillation to obtain 1,480 g of a polycarbonate.

As a result of analysis, it was found that the polycarbonate thus obtained is a mixture of a polycarbonate having the following structure and its condensate.

$$C_7H_{15}OCOOCH_2CH_2CH(CH_3)CH_2CH_2OCOOC_7H_{15}$$

Table 1 shows fundamental performance as lubricating oil of the polycarbonate thus obtained.

TABLE 1

| | Referential Example 1 |
|---|---|
| Viscosity characteristics | |
| 100° C. Kinematic viscosity [cSt] | 5.5 |
| Viscosity index | 133 |
| Load bearing value [lbf] | 860 |
| Compatibility with R-134a | |
| (1) (Note 1) | ○ |
| (2) Critical temperature [°C.] (Note 2) | |
| High temperature side | 94 |
| Low temperature side | −59 |

(Note 1) ○: Compatible x : Incompatible
(Note 2) Lubricating oil: 15 wt % R-134a: 85 wt %

EXAMPLE 1

There was prepared a mixture of 100 parts by weight of the polycarbonate of Referential Example 1 as a base lubricating oil and 1.0 part by weight of 2,6-di-t-butyl-4-hydroxytoluene. The mixture thus obtained was tested for carbon dioxide concentration and compatibility with Freon R134a in accordance with the aforementioned test method.

Results obtained are shown in Table 2.

EXAMPLE 2

There was obtained a mixture by repeating the same procedure as in Example 1 except that dilauryl thiodipropionate was used in place of the 2,6-di-t-butyl-4-hydroxytoluene.

The mixture thus obtained was tested for carbon dioxide gas concentration and compatibility with Freon R-134a in accordance with the aforementioned test method.

Results obtained are shown in Table 2.

EXAMPLE 3

There was obtained a mixture by repeating the same procedure as in Example 1 except that the amount of the 2,6-di-t-butyl-4-hydroxytoluene used was changed to 0.05 part by weight, and there was further used 1.0 part by weight of phenyldidecyl phosphite.

The mixture thus obtained was tested for carbon dioxide gas concentration and compatibility with Freon R-134a in accordance with the aforementioned test method.

Results obtained are shown in Table 2.

EXAMPLE 4

There was obtained a mixture by repeating the same procedure as in Example 3 except that 1.0 part by weight of dilauryl thiodipropionate was used in place of the phenyldidecyl phosphite.

The mixture thus obtained was tested for carbon dioxide concentration and compatibility with Freon R-134a in accordance with the aforementioned test method.

Results obtained are shown in Table 2.

EXAMPLE 5

There was obtained a mixture by repeating the same procedure as in Example 1 except that epoxidized octyl stearate was used in place of the 2,6-di-t-butyl-4-hydroxytoluene.

The mixture thus obtained was tested for carbon dioxide concentration and compatibility with Freon R-134a in accordance with the aforementioned test method.

Results obtained are shown in Table 2.

EXAMPLE 6

There was obtained a mixture by repeating the same procedure as in Example 1 except that 4,4'-bis(α,α-dimethylbenzyl)diphenylamine was used in place of the 2,6-di-t-butyl-4-hydroxytoluene.

The mixture thus obtained was tested for carbon dioxide concentration and compatibility with Freon R-134a in accordance with the aforementioned test method.

Results obtained are shown in Table 2.

COMPARATIVE EXAMPLE 1

The polycarbonate (base oil) of Referential Example 1 was tested for carbon dioxide gas concentration and compatibility with Freon R-134a in accordance with the aforementioned test method.

Results obtained are shown in Table 2.

TABLE 2

| | Ex. 1 | Ex. 2 | Ex. 3 | Ex. 4 | Ex. 5 | Ex. 6 | Comp. Ex. 1 |
|---|---|---|---|---|---|---|---|
| Base oil [polycarbonate] (part by wt) | Ref. Ex. 1 100 | Ref. Ex. 1 100 | Ref. Ex. 1 100 | Ref. Ex. 1 100 | Ref. Ex. 1 100 | Ref. Ex. 1 100 | Ref. Ex. 1 100 |
| Additive | | | | | | | |
| 1) Kind (part by wt) | 2,6-di-t-butyl-4-hydroxy- | Di-lauryl-thiodi- | Phenyl-di-decyl phosphite | Dilauryl thiodi-propio- | Epoxi-dized octyl- | 4.4'-bis (α,α-dimethyl- | None |

TABLE 2-continued

| | Ex. 1 | Ex. 2 | Ex. 3 | Ex. 4 | Ex. 5 | Ex. 6 | Comp. Ex. 1 |
|---|---|---|---|---|---|---|---|
| | toluene 1.0 | propionate 1.0 | 1.0 | nate 1.0 | stearate 1.0 | benzyl diphenylamine 1.0 | |
| 2) Kind (part by wt) | | | 2,6-di-t-butyl-4-hydroxytoluene 0.05 | 2,6-di-t-butyl-4-hydroxytoluene 0.05 | | | |
| Compatibility with R-134a [note 1] | ○ | ○ | ○ | ○ | ○ | ○ | ○ |
| Carbon dioxide gas concentration [vol %] | 0.65 | 1.86 | 0.85 | 0.78 | 1.48 | 0.94 | 2.0 |

Note 1:
In accordance with the test/method (3) of compatibility with R-134a

[Referential example, examples and comparative example of the second lubricating oil composition]

REFERENTIAL EXAMPLE 2

A 5-liter reactor equipped with a distillation column of a 10-sieve tray was charged with 271 g of a propylene oxide adduct of succrose having an average molecular weight (Mn) of 740 (SU-460 of PPG-polyfunctional Series, a product of Mitsui Toatsu Chem. Inc.), 1492 g of methyl isobutylcarbinol, 1320 g of dimethyl carbonate and 0.7 g of a methanol solution of 28% by weight of $NaOCH_3$ (catalyst).

This mixture was allowed to undergo reaction at ordinary pressure and 120°-180° C. for 13 hours.

After removal of the catalyst by adding water to the reaction mixture thus obtained, dimethylisobutyl carbonate formed is distilled off to obtain 460 g of a polycarbonate.

The polycarbonate obtained is a viscous liquid, and from the results of $^1$H-NMR, $^{13}$C-NMR, IR and GCP analysis, it was found that the polycarbonate has a structure represented by the following formula.

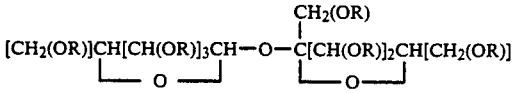

wherein R is $-[CH_2CH(CH_3)O]_nCOOC_6H_{13}$, in which an average value of n is about 1.1.

The polycarbonate was analyzed by means of $^{13}$C-NMR, whereby such peaks as mentioned below appeared in the chart. In this measurement, $CDCl_3$ was used as the solvent therefor.

16-19 ppm, 20.4 ppm, 22.3 ppm, 22.6 ppm, 24.6 ppm, 45.1 ppm, 55.4 ppm, 65-67 ppm, 69.5-73 ppm, 73.5 ppm, 73-77 ppm, 77-80 ppm, 80-81 ppm, 81-82 ppm, 82-83.5 ppm, 89-91 ppm, 103-105 ppm, 154-155.5 ppm.

The infrared absorption spectrum of the polycarbonate obtained are shown below, wherein the main peaks observed are as in the following.

$\upsilon$ C—H 2800-3000 $cm^{-1}$
$\delta$ C—H 1450 $cm^{-1}$
$\upsilon$ C=O 1740 $cm^{-1}$
$\upsilon$ C—O 1250-1290 $cm^{-1}$
$\upsilon$ C—O—C 1100 $cm^{-1}$ Further, the results of GPC analysis of the polycarbonate obtained are shown below.

Weight average molecular weight (Mw)/number average molecular weight (Mn) GPC: 1.232
Weight average molecular weight (Mw) as measured by the polystyrene conversion method: 1630
Amount of sodium remaining in the product: Not more than 0.01 ppm
Total acid value in the product: Not more than 0.01

Results of evaluation of fundamental performance as a lubricating oil of the polycarbonate obtained are shown in Table 3.

TABLE 3

| | Referential Example 2 |
|---|---|
| Viscosity characteristics | |
| 100° C. Kinematic viscosity [cSt] | 27 |
| Value of load bearing capacity [lbf] | 910 |
| Compatibility with R-134a | |
| (1) (Note 1) | ○ |
| (2) Critical temperature [°C] (Note 2) | |
| High temperature side | +88 |
| Low temperature side | <−65 |

(Note 1) ○ : Compatible x: Incompatible
(Note 2) Lubricating oil: 15 wt % R-134a: 85 wt %

EXAMPLE 7

A mixture was prepared by mixing together 100 parts by weight of the polycarbonate of Referential Example 2 as a lubricating base oil, 1.0 part by weight of diphenyloctyl phosphite, 0.5 part by weight of tricresyl phosphate and 0.5 part by weight of phenylglycidyl ether. The mixture obtained was tested for heat stability, frictional characteristics, compatibility with Freon R-134a and carbon dioxide concentration in accordance with the aforementioned test method.

Results obtained are shown in Table 4.

EXAMPLE 8

Example 7 was repeated except that the amount of the diphenyloctyl phosphite used was changed to 3.0 parts by weight, and the tricresyl phosphate and phenylglycidyl ether were not used.

Results obtained are shown in Table 4.

COMPARATIVE EXAMPLE 2

The polycarbonate obtained in Referential Example 2 was tested for in the same manner as in Example 7.

Results obtained are shown in Table 4.

TABLE 4

| | Example 7 | Example 8 | Comparative Example 2 |
|---|---|---|---|
| Base oil (polycarbonate) (wt part) | Ref. Ex. 2 100 | Ref. Ex. 2 100 | Ref. Ex. 2 100 |
| Triester phosphite compound (wt part) | Diphenyloctyl phosphite 1.0 | Diphenyloctyl phosphite 1.0 | None |
| Other additives (wt part) | Tricresyl phosphate 0.5 Phenylglicidyl ether 0.5 | None | None |
| Heat stability | | | |
| Change in weight (%) | −0.8 | −0.3 | −4.1 |
| Total acid value (mg-KOH/g) | +0.04 | +0.01 | 1.15 |
| Change in kinematic viscosity (%) | +0.8 | +0.3 | +11.2 |
| Frictional characteristics | | | |
| Frictional index | 0.08 | 0.07 | 0.08 |
| Depth of frictional trace | 0.04 | 0.04 | 0.04 |
| Compatibility with R-134a (Note 1) | ○ | ○ | ○ |
| Carbon dioxide gas concentration (ppm) | 150 | 120 | 1,800 |
| Volume resisitivity (Ω · cm) | $2.0 \times 10^{11}$ | $3.3 \times 10^{11}$ | $4.5 \times 10^{11}$ |

Note 1:
According to the aforementioned test/method (3) of the compatibility with R-134a

[Referential example, examples and comparative examples of the third lubricating oil composition of the present invention]

REFERENTIAL EXAMPLE 3

A 5-liter reactor equipped with a distillation column of a 10-sieve tray was charged with 705 g of a propylene oxide adduct of sorbitol having an average molecular weight (Mn) of 740 (a product under a trade name of HS-700A of Mitsui Toatsu Chem. Inc.), 2560 g of diisobutyl carbonate and 3 g of a methanol solution of 28% by weight of $NaOCH_3$ (catalyst).

This mixture was allowed to undergo reaction under reduced pressure (about 100 mmHg) at 135° C. for 14 hours.

After removal of the catalyst by adding water to the reaction mixture thus obtained, diisobutyl carbonate formed was distilled off to obtain 940 g of a polycarbonate.

The polycarbonate obtained was a viscous liquid and, from the results of $^1$H-NMR, $^{13}$C-NMR, IR and GPC analysis, it was found that the polycarbonate has a structure represented by the following formula.

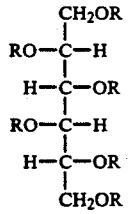

CHzOR wherein $-CH_2CH(CH_3)O]_nCOOC_4H_9$ in which an average value of n is about 1.5.

The polycarbonate obtained was analyzed by means of $^{13}$C-NMR, whereby such peaks as mentioned below appeared in the chart. In this measurement, $CDCl_3$ was used as the solvent therefor.

16.5–17.5 ppm, 18.8 ppm, 27.7 ppm, 70.5–72 ppm, 72.5–74 ppm, 74.5–76 ppm, 77–81 ppm, 154–155 ppm.

Further, data of the infrared absorption spectrum of the polycarbonate obtained are shown below, wherein the main peaks observed are as in the following.

$\nu$ C—H 2800–3000 $cm^{-1}$
$\delta$ C—H 1460 $cm^{-1}$
$\nu$ C=O 1740 $cm^{-1}$
$\nu$ C—O 1240–1290 $cm^{-1}$
$\nu$ C—O—C 1100 $cm^{-1}$ The results of GPC analysis of the polycarbonate obtained are shown below.

Weight average molecular weight (Mw)/number average molecular weight (Mn) GPC: 1.544

Weight average molecular weight (Mw) as measured by the polystyrene base method: 2682

Amount of sodium remaining in the product: Not more than 0.01 ppm

Total acid value in the product: Not more than 0.01

The results of evaluation of fundamental performance as a lubricating oil of the polycarbonate obtained are shown in Table 5.

TABLE 5

| | Referential Example 3 |
|---|---|
| Viscosity characteristics | |
| 100° C. Kinematic viscosity [cSt] | 69 |
| Load bearing value [lbf] | 940 |
| Compatibility with R-134a | |
| (1) (Note 1) | ○ |
| (2) Critical temperature [°C.] (Note 2) | |
| High temperature side | +68 |
| Low temperature side | <−65 |

(Note 1) ○ : Compatible x: Incompatible
(Note 2) Lubricating oil: 15 wt % R-134a: 85 wt %

EXAMPLE 9

A mixture was prepared by mixing 100 parts by weight of the polycarbonate of Referential Example 3 as a lubricating base oil with 1.0 part by weight of diphenyldecyl phosphite. The mixture thus obtained was tested for heat stability, frictional characteristics, compatibility with Freon R-134a and carbon dioxide gas concentration in accordance with the aforementioned test method.

EXAMPLE 10

The same procedure as described in Example 9 was carried out except that phenyldidecyl phosphite was used in place of the diphenyldecyl phosphite.

Results obtained are shown in Table 6.

EXAMPLE 11

The same procedure as described in Example 9 was carried out except that diphenyloctyl phosphite was used in place of the diphenyldecyl phosphite, and there was further used 0.5 part by weight of t-butylated hydroxytoluene.

Results obtained are shown in Table 6.

EXAMPLE 12

The same procedure as described in Example 9 was carried out except that diphenyloctyl phosphite was used in place of the diphenyldecyl phosphite, and there was further used 0.5 part of tricresyl phosphate.

Results obtained are shown in Table 6.

COMPARATIVE EXAMPLE 3

The polycarbonate obtained in Referential Example 3 was tested for in the same manner as in Example 9.

Results obtained are shown in Table 6.

COMPARATIVE EXAMPLE 4

The same procedure as described in Example 9 was carried out except that 0.0001 part by weight of diphenyloctyl phosphite was used in place of 1.0 part by weight of the diphenyldecyl phosphite.

Results obtained are shown in Table 6.

TABLE 6

| | Ex. 9 | Ex. 10 | Ex. 11 | Ex. 12 | Comp. Ex. 3 | Comp. Ex. 4 |
|---|---|---|---|---|---|---|
| Base oil (polycarbonate) (wt part) | Ref. Ex. 3 100 | Ref. Ex. 3 100 | Ref. Ex. 3 100 | Ref. Ex. 3 100 | Ref. Ex. 3 100 | Ref. Ex. 3 100 |
| Triester phosphite compound (wt part) | Diphenyl-decyl phosphite 1.0 | Phenyl-didecyl phosphite 1.0 | Diphenyl-octyl phosphite 1.0 | Diphenyl-octyl phosphite 1.0 | None | Diphenyl-octyl phosphite 0.0001 |
| Other additives (wt part) | None | None | t-buthy-lated hydroxy-toluene 0.5 | Tricresyl phosphate 0.5 | None | None |
| Heat stability | | | | | | |
| Change in weight (%) | −0.7 | −0.7 | −0.7 | −0.7 | −3.7 | −2.9 |
| Total acid value (mg-KOH/g) | +0.03 | +0.04 | +0.03 | +0.02 | 0.72 | 0.08 |
| Change in kinematic viscosity (%) | +0.5 | +0.5 | +0.3 | +0.5 | +5.2 | +1.5 |
| Frictional characteristics | | | | | | |
| Frictional index | 0.08 | 0.08 | 0.08 | 0.08 | 0.09 | 0.08 |
| Depth of frictional trace | 0.4 | 0.4 | 0.4 | 0.04 | 0.07 | 0.04 |
| Compatibility with R-134a (Note 1) | ○ | ○ | ○ | ○ | ○ | ○ |
| Carbon dioxide gas concentration (ppm) | 150 | 200 | 100 | <100 | 1,200 | 500 |
| Volume resisitivity (Ω · cm) | $1.1 \times 10^{12}$ | $1.2 \times 10^{12}$ | $0.9 \times 10^{12}$ | $1.0 \times 10^{12}$ | $1.2 \times 10^{12}$ | $1.0 \times 10^{12}$ |

Note 1:
According to the aforementioned test/method (3) of the compatibility with R-134a

What we claim is:

1. A lubricating oil composition comprising
(1) 100 parts by weight of a polycarbonate represented by the following general formula (I),
(2) 0.0001–5 parts by weight of each of a phenol compound (b) and a sulfur compound (c), and
(3) 0–5 parts by weight of a triester phosphite compound (e) and/or a triester phosphate compound (f), $$\frac{R_1OCOO((R_2O)_pCOO)_nR_3}{[R_1OCOO[(R_2O)_pCOO]_nR_3]} \quad \text{(I)}$$

wherein $R_1$ and $R_3$ each are independently a hydrocarbon group having not more than 30 carbon atoms or a hydrocarbon group containing an ether bond and having 2 to 30 carbon atoms, $R_2$ is an alkylene group having 2 to 24 carbon atoms, p is an integer of 1 to 100, and n is an integer of 1 to 10.

2. A refrigerator lubricating oil composition comprising the lubricating oil of claim 1 and a refrigerant.

3. The refrigerator lubricating oil composition of claim 2 wherein said composition contains a hydrogenated fluorocarbon (HFC) refrigerant.

4. A lubricating oil composition comprising
(1) 100 parts by weight of a polycarbonate represented by the following general formula (II),
(2) 0.0002–5 parts by weight of a triester phosphite compound (e), and
(3) 0–5 parts by weight of at least one compound selected from the group consisting of a triester phosphate compound (f), an epoxy compound (a) and a phenol compound (b), Su-O-R (II)

wherein Su is a group represented by the following formula (A), and R is a group selected from the groups represented by the following formulae (B), (C), (D), (E) and (F), $$(CH_2(OR_4))CH(CH(OR_4))_3CH- \quad \text{(A)}$$

$$(CH_2(OR_4))CH(CH(OR_4))_2C(CH_2(OR_4))- \quad \text{(B)}$$

$$(CH_2(OR_4))CH-O-CH(OR_4))_3CH- \quad \text{(C)}$$

$$CH(OR_4)(CH(OR_4))_3CHCH_2- \quad \text{(D)}$$

$$-(C_3H_6O)_nCOOR_5 \quad \text{(E)}$$

$$-(C_3H_6O)_n(C_2H_4O)_pCOOR_5 \quad \text{(F)}$$

in which $R_4$ is a group represented by the above-mentioned formula (E) or (F), wherein $R_5$ each is independently a hydrocarbon group having not more than 30 carbon atoms or a hydrocarbon group containing an ether bond and having 2 to 30 carbon atoms, an n and p are each an integer of 1 to 12.

5. A refrigerator lubricating oil composition comprising the lubricating oil of claim 4 and a refrigerant.

6. The refrigerator lubricating oil composition of claim 5 wherein said lubricating oil composition contains a hydrogenated fluorocarbon (HFC) refrigerant.

7. A lubricating oil composition comprising (1) 100 parts by weight of a polycarbonate represented by the following general formula (III), (2) 0.0002–5 parts by weight of a triester phosphite compound (e), and (3) 0–5 parts by weight of at least one compound selected from the group consisting of a triester phosphate compound (f), an epoxy compound (a) and a phenol compound (b), $$(R_4O)CH_2(CH(OR_4))_mCH_2(OR_4) \quad \text{(III)}$$

wherein $R_4$ is a group represented by the following formula (E) or (F), and m is an integer of 1 to 6, $$-(C_3H_6O)_nCOOR_5 \quad \text{(E)}$$

$$-(C_3H_6O)_n(C_2H_4O)_pCOOR_5 \quad \text{(F)}$$

wherein $R_5$ is independently a hydrocarbon group having not more than 30 carbon atoms or a hydrocarbon group containing an ether bond and having 2 to 30 carbon atoms, an n and p are each an integer of 1 to 12.

8. A refrigerator lubricating oil composition comprising the lubricating oil of claim 7 and a refrigerant.

9. The refrigerator lubricating oil composition of claim 8 wherein said lubricating oil composition contains a hydrogenated fluorocarbon (HFC) refrigerant.

10. A lubricating oil composition comprising (1) 100 parts by weight of a polycarbonate represented by the following general formula (I), (2) 0.0001–5 parts by weight of a phenol compound (a), and (3) 0.0001–5 parts by weight of dilauryl thiodipropionate or 4,4'-thio-bis (3-methyl-6-t-butylphenol $$R_1OCOO(R_2O)_pCOO)_nR_3 \quad \text{(I)}$$

wherein $R_1$ and $R_3$ each are independently a hydrocarbon group having not more than 30 carbon atoms or a hydrocarbon group containing an ether bond and having 2 to 30 carbon atoms, $R_2$ is an alkylene group having 2 to 24 carbon atoms, p is an integer of 1 to 100, and n is an integer of 1 to 10.

11. A refrigerator lubricating oil composition comprising the lubricating oil of claim 10 and a refrigerant.

12. The lubricating oil composition of claim 11 wherein said composition contains a hydrogenated fluorocarbon (HFC) refrigerant.

13. A lubricating oil composition comprising (1) 100 parts by weight of a polycarbonate represented by the following general formula (I), (2) 0.0001–5 parts by weight of a phenol compound (a), and (3) 0.01–5 parts by weight of a triester phosphite compound (e)

$$R_1OCOO(R_2O)_pCOO)_nR_3 \quad \text{(I)}$$

wherein $R_1$ and $R_3$ each are independently a hydrocarbon group having not more than 30 carbon atoms or a hydrocarbon group containing an ether bond and having 2 to 30 carbon atoms, $R_2$ is an alkylene group having 2 to 24 carbon atoms, p is an integer of 1 to 100, and n is an integer of 1 to 10.

14. A refrigerator lubricating oil composition comprising the lubricating oil of claim 13 and a refrigerant.

15. The refrigerator lubricating oil composition of claim 14 wherein said composition contains a hydrogenated fluorocarbon (HFC) refrigerant.

* * * * *

UNITED STATES PATENT AND TRADEMARK OFFICE

CERTIFICATE OF CORRECTION

PATENT NO. : 5,326,486

DATED : July 5, 1994

INVENTOR(S) : Mizui, et al

It is certified that error appears in the above-indentified patent and that said Letters Patent is hereby corrected as shown below:

Col. 32, line 10, (claim 1) delete "$R_1OCOO((R_2O)_pCOO)_nR_3$ $\overline{[R_1OCOO[(R_2O)_pCOO]_NR_3]}$ "

and substitute therefor --$R_1OCOO((R_2O)_pCOO)_nR_3$--.

Col. 34, line 16, (claim 10) delete "(3-methyl-6-t-butylphenol"

and substitute therefor --(3-methyl-6-t-butylphenol),--.

Col. 34, line 19, (claim 10) and line 39, (claim 13) each formula (I), delete "$R_1OCOO(R_2O)_pCOO)_nR_3$" and substitute therefor -$R_1OCOO((R_2O)_pCOO)_nR_3$-

Signed and Sealed this

Twenty-eight Day of March, 1995

Bruce Lehman

*Attest:*

BRUCE LEHMAN

*Attesting Officer*

*Commissioner of Patents and Trademarks*